US008876549B2

(12) United States Patent
Van Swearingen et al.

(10) Patent No.: US 8,876,549 B2
(45) Date of Patent: Nov. 4, 2014

(54) CAPACITIVELY COUPLED FLAT CONDUCTOR CONNECTOR

(71) Applicant: Andrew LLC, Hickory, NC (US)

(72) Inventors: Kendrick Van Swearingen, Woodridge, IL (US); Jeffrey D Paynter, Momence, IL (US); James P Flemming, Orland Park, IL (US); Frank A. Harwath, Naperville, IL (US)

(73) Assignee: Andrew LLC, Hickory, NC (US)

( * ) Notice: Subject to any disclaimer, the term of this patent is extended or adjusted under 35 U.S.C. 154(b) by 140 days.

(21) Appl. No.: 13/672,965

(22) Filed: Nov. 9, 2012

(65) Prior Publication Data

US 2013/0065422 A1 Mar. 14, 2013

Related U.S. Application Data

(63) Continuation-in-part of application No. 13/571,073, filed on Aug. 9, 2012, and a continuation-in-part of application No. 13/427,313, filed on Mar. 22, 2012, and a continuation-in-part of application No. 13/294,586, filed on Nov. 11, 2011, now Pat. No. 8,550,843, said application No. 13/571,073 is a continuation-in-part of application No. 13/240,344, filed on Sep. 22, 2011, and a continuation-in-part of application No. 13/208,443, filed on Aug. 12, 2011, now abandoned, said application No. 13/240,344 is a continuation-in-part of application No. 13/170,958, filed on Jun. 28, 2011, and a continuation-in-part of application No. 13/161,326, filed on Jun. 15, 2011, now Pat. No. 8,365,404, and a continuation-in-part of application No. 12/980,013, filed on Dec. 28, 2010, now Pat. No. 8,453,320, and a continuation-in-part of application No. 12/974,765, filed on Dec. 21, 2010, now Pat. No. 8,563,861, and a continuation-in-part of application No. 12/962,943, filed on Dec. 8, 2010, now Pat. No. 8,302,296, and a continuation-in-part of application No. 12/951,558, filed on Nov. 22, 2010, application No. 13/672,965, which is a continuation-in-part of application No. 13/644,081, filed on Oct. 3, 2012, now Pat. No. 8,479,383.

(51) Int. Cl.
*H01R 9/05* (2006.01)
*H01R 13/629* (2006.01)
*H01R 13/639* (2006.01)

(52) U.S. Cl.
CPC ..... *H01R 13/629* (2013.01); *H01R 13/6395* (2013.01)
USPC ..... 439/578; 439/581; 439/681

(58) Field of Classification Search
CPC .... H01R 2103/00; H01R 24/40; H01R 24/50; H01R 13/6456
USPC ..... 439/378, 578, 581, 681, 680
See application file for complete search history.

(56) References Cited

U.S. PATENT DOCUMENTS

| | | | |
|---|---|---|---|
| 479,525 | A | 11/1936 | Weaver |
| 2,060,913 | A | 5/1940 | Hoover |

(Continued)

FOREIGN PATENT DOCUMENTS

| | | |
|---|---|---|
| EP | 2219267 | 8/2010 |
| WO | 2009134792 | 11/2009 |

OTHER PUBLICATIONS

Sung Gon Kim, International Search Report of Counterpart International Application No. PCT/US12/64573, Apr. 1, 2013, Daejeon Metropolitan City, Korea.
Gon Sung Kim, International Search Report for PCT/US13/59392, Dec. 23, 2013, Daejeon Metropolitan City, Republic of Korea.

*Primary Examiner* — Hae Moon Hyeon
(74) *Attorney, Agent, or Firm* — Babcock IP, PLLC

(57) ABSTRACT

A capacitively coupled flat conductor connector is provided with a male connector body and a female connector body. An alignment insert is coupled to the male connector body, the alignment insert dimensioned to support a predefined length of an inner conductor. An alignment receptacle is coupled to the female connector body, the alignment receptacle dimensioned to receive a connector end of the alignment insert to seat an overlapping portion of an inner conductor and an inner conductor trace parallel with one another against opposite sides of a dielectric spacer. An outer conductor dielectric spacer isolates the contacting elements of the outer conductor signal path between the male and female connectors.

20 Claims, 15 Drawing Sheets

(56) References Cited

U.S. PATENT DOCUMENTS 2,200,776 A * 5/1940 Hoover ..... 156/55
2,267,455 A 7/1950 Raymond
2,516,529 A 8/1958 Peterson
2,847,499 A 7/1961 Ayer et al.
3,089,105 A 5/1963 Alford
2,994,050 A 6/1966 Walsh et al.
3,258,724 A 6/1966 Walsh et al.
3,586,757 A 6/1971 Haldeman, Jr.
3,617,607 A 11/1971 Williams
3,693,238 A 9/1972 Hoch et al.
3,701,965 A 10/1972 DuRocher et al.
3,757,029 A 9/1973 Marshall
3,897,896 A 8/1975 Louw et al.
3,897,897 A 8/1975 Satzler et al.
3,917,497 A 11/1975 Stickler
3,980,976 A 9/1976 Tadama et al.
4,090,898 A 5/1978 Tuskos
4,226,652 A 10/1980 Berg
4,235,498 A 11/1980 Snyder
4,340,269 A 7/1982 McGeary
4,353,761 A 10/1982 Woerz et al.
4,382,236 A 5/1983 Suzuki
4,397,515 A 8/1983 Russell
4,441,088 A 4/1984 Anderson
4,457,795 A 7/1984 Mason
4,464,001 A 8/1984 Collins
4,490,690 A 12/1984 Suzuki
4,502,748 A 3/1985 Brush, Sr. et al.
4,519,661 A 5/1985 Brush, Sr. et al.
4,534,751 A 8/1985 Fortuna et al.
4,584,037 A 4/1986 Fortuna et al.
4,586,008 A 4/1986 Raleigh
4,715,821 A 12/1987 Axell
4,726,782 A 2/1988 Hager et al.
4,737,119 A 4/1988 Stieler
4,741,788 A 5/1988 Clark et al.
4,743,331 A 5/1988 Nuttall et al.
4,746,305 A 5/1988 Nomura
4,867,370 A 9/1989 Welter et al.
4,884,982 A 12/1989 Fleming et al.
4,891,015 A 1/1990 Oldfield
4,943,245 A 7/1990 Lincoln
5,021,007 A 6/1991 Viaud
5,046,952 A 9/1991 Cohen et al.
5,064,485 A 11/1991 Smith et al.
5,065,122 A 11/1991 Juskey et al.
5,068,632 A * 11/1991 Champeau ..... 333/238
5,137,470 A 8/1992 Doles
5,167,533 A 12/1992 Rauwolf
5,186,644 A 2/1993 Pawlicki et al.
5,203,079 A 4/1993 Brinkman et al.
5,276,415 A 1/1994 Lewandowski et al.
5,299,939 A 4/1994 Walker et al.
5,354,217 A 10/1994 Gabel et al.
5,383,272 A 1/1995 Mattingly et al.
5,393,933 A 2/1995 Goertz
5,431,580 A 7/1995 Tabata
5,545,059 A 8/1996 Nelson
5,561,900 A 10/1996 Hosler, Sr.
5,659,889 A 8/1997 Cockson
5,662,488 A 9/1997 Alden
5,722,847 A 3/1998 Haag
5,722,856 A 3/1998 Fuchs et al.
5,791,919 A 8/1998 Brisson et al.
5,796,315 A 8/1998 Gordon et al.
5,802,710 A 9/1998 Bufanda et al.
5,823,824 A 10/1998 Mitamura et al.
5,830,009 A 11/1998 Tettinger
5,847,324 A 12/1998 Farquhar et al.
5,900,589 A 5/1999 Brunt
5,905,465 A 5/1999 Olson et al.
5,977,841 A 11/1999 Lee et al.
6,005,193 A 12/1999 Markel
6,032,835 A 3/2000 Burt
6,039,594 A 3/2000 Zuppa
6,055,722 A 5/2000 Tighe et al.
6,056,577 A 5/2000 Blanchet
6,105,849 A 8/2000 Mochizuki et al.
6,133,532 A 10/2000 Lundback et al.
6,139,354 A 10/2000 Broussard
6,176,716 B1 1/2001 Mercurio et al.
6,183,293 B1 2/2001 Kieninger
6,225,563 B1 5/2001 Poulsen
6,332,808 B1 12/2001 Kanda et al.
6,414,636 B1 7/2002 Godard et al.
6,422,893 B1 7/2002 Caldwell
6,428,354 B1 8/2002 Meyer et al.
6,471,545 B1 10/2002 Hosler, Sr.
6,496,353 B1 12/2002 Chio
6,501,350 B2 12/2002 Lester
6,545,223 B2 4/2003 Baldock
6,588,646 B2 7/2003 Loprire
6,607,399 B2 8/2003 Endo et al.
6,608,256 B2 8/2003 Suzuki et al.
6,632,118 B2 10/2003 Jacob
6,653,570 B1 11/2003 Elrod
6,666,701 B1 12/2003 Burkhardt et al.
6,683,254 B1 1/2004 Gunnels
6,685,493 B2 2/2004 Birkenmaier et al.
6,752,668 B2 6/2004 Koch, Jr.
6,776,620 B2 8/2004 Noda
6,793,095 B1 9/2004 Dulisse et al.
6,798,310 B2 9/2004 Wong et al.
6,808,407 B1 10/2004 Cannon
6,811,423 B2 11/2004 Yoshigi et al.
6,814,625 B2 11/2004 Richmond et al.
6,837,751 B2 1/2005 Vanden Wymelenberg et al.
6,921,283 B2 7/2005 Zahlit et al.
6,926,555 B2 8/2005 Nelson
6,932,644 B1 8/2005 Taylor
7,034,229 B2 4/2006 Victor
7,044,785 B2 5/2006 Harwath et al.
7,077,677 B2 7/2006 Sanuki
7,134,190 B2 11/2006 Bungo et al.
7,144,274 B2 12/2006 Taylor
7,170,008 B2 1/2007 Victor
7,173,190 B2 2/2007 Bothe et al.
7,217,154 B2 5/2007 Harwath
7,220,332 B2 5/2007 Curro et al.
7,304,246 B2 12/2007 Huffman
7,347,738 B2 3/2008 Hsieh et al.
7,388,155 B2 6/2008 Forbes
D576,344 S 9/2008 Conroy
7,448,906 B1 11/2008 Islam
7,479,033 B1 1/2009 Sykes et al.
7,482,535 B2 1/2009 Sexton et al.
7,482,540 B2 1/2009 Shukushima et al.
7,520,779 B2 4/2009 Arnaud et al.
7,553,177 B2 6/2009 Antonini et al.
7,607,942 B1 10/2009 Van Swearingen
7,625,226 B1 12/2009 Gastineau
7,661,984 B2 2/2010 McMullen et al.
7,737,358 B2 6/2010 Hopkinson et al.
7,737,359 B2 6/2010 Sexton et al.
7,754,038 B2 7/2010 Ripplinger et al.
7,798,847 B2 9/2010 Islam
7,806,444 B2 10/2010 Blivet et al.
7,819,302 B2 10/2010 Bolser et al.
7,819,698 B2 10/2010 Islam
7,823,763 B2 11/2010 Sachdev et al.
7,902,456 B2 3/2011 Witthoft et al.
8,174,132 B2 5/2012 Van Swearingen
2003/0071640 A1 4/2003 Haag et al.
2003/0137372 A1 7/2003 Fehrenbach et al.
2005/0164525 A1 7/2005 Benson et al.
2007/0149008 A1 6/2007 Pabst

(56) References Cited

U.S. PATENT DOCUMENTS

| | | | | |
|---|---|---|---|---|
| 2010/0041271 | A1 | 2/2010 | Van Swearingen et al. | |
| 2010/0124839 | A1 | 5/2010 | Montena | |
| 2010/0130060 | A1 | 5/2010 | Islam | |
| 2010/0190378 | A1 | 7/2010 | Islam | |
| 2010/0261361 | A1 | 10/2010 | Kasparian et al. | |
| 2011/0143602 | A1 | 6/2011 | Niitsu | |
| 2013/0037301 | A1 * | 2/2013 | Paynter et al. | 174/115 |
| 2013/0038412 | A1 * | 2/2013 | Moe et al. | 333/238 |

* cited by examiner

CAPACITIVELY COUPLED FLAT CONDUCTOR CONNECTOR

BACKGROUND

1. Field of the Invention

This invention relates to electrical cable connectors. More particularly, the invention relates to a flat inner conductor coaxial connector with improved passive intermodulation distortion (PIM) electrical performance and mechanical interconnection characteristics.

2. Description of Related Art

Coaxial cable connectors are used, for example, in communication systems requiring a high level of precision and reliability.

During systems installation, rotational forces may be applied to the installed connector, for example as the attached coaxial cable is routed toward the next interconnection, maneuvered into position and/or curved for alignment with cable supports and/or retaining hangers. Rotation of the coaxial cable and coaxial connector with respect to each other may damage the connector, the cable and/or the integrity of the cable/connector inter-connection. Further, once installed, twisting, bending and/or vibration applied to the interconnection over time may degrade the connector to cable interconnection and/or introduce PIM.

PIM is a form of electrical interference/signal transmission degradation that may occur with less than symmetrical interconnections and/or as electro-mechanical interconnections shift or degrade over time, for example due to mechanical stress, vibration, thermal cycling, oxidation formation and/or material degradation. PIM is an important interconnection quality characteristic, as PIM from a single low quality interconnection may degrade the electrical performance of an entire Radio Frequency (RF) system.

Prior coaxial cables typically have a coaxial configuration with a circular outer conductor evenly spaced away from a circular inner conductor by a dielectric support such as polyethylene foam or the like. The electrical properties of the dielectric support and spacing between the inner and outer conductor define a characteristic impedance of the coaxial cable. Circumferential uniformity of the spacing between the inner and outer conductor prevents introduction of impedance discontinuities into the coaxial cable that would otherwise degrade electrical performance.

A stripline is a flat conductor sandwiched between parallel interconnected ground planes. Striplines have the advantage of being non-dispersive and may be utilized for transmitting high frequency RF signals. Striplines may be cost-effectively generated using printed circuit board technology or the like. However, striplines may be expensive to manufacture in longer lengths/larger dimensions. Further, where a solid stacked printed circuit board type stripline structure is not utilized, the conductor sandwich is generally not self-supporting and/or aligning, compared to a coaxial cable, and as such may require significant additional support/reinforcing structure.

Competition within the RF cable industry has focused attention upon reducing materials and manufacturing costs, electrical characteristic uniformity, defect reduction and overall improved manufacturing quality control.

Therefore, it is an object of the invention to provide a coaxial cable and method of manufacture that overcomes deficiencies in such prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

The inventors have recognized that the prior accepted coaxial cable design paradigm of concentric circular cross section design geometries results in unnecessarily large coaxial cables with reduced bend radius, excess metal material costs and/or significant additional manufacturing process requirements.

The inventors have further recognized that the application of a flat inner conductor, compared to conventional circular inner conductor configurations, enables precision tunable capacitive coupling for the reduction and/or elimination of PIM from inner conductor connector interface interconnections. Further, application of an outer conductor dielectric spacer also between the interconnections of the outer conductor connector interface can result in a fully capacitively coupled connection interface which may entirely eliminate the possibility of PIM generation from the connector interface.

Figure 1:
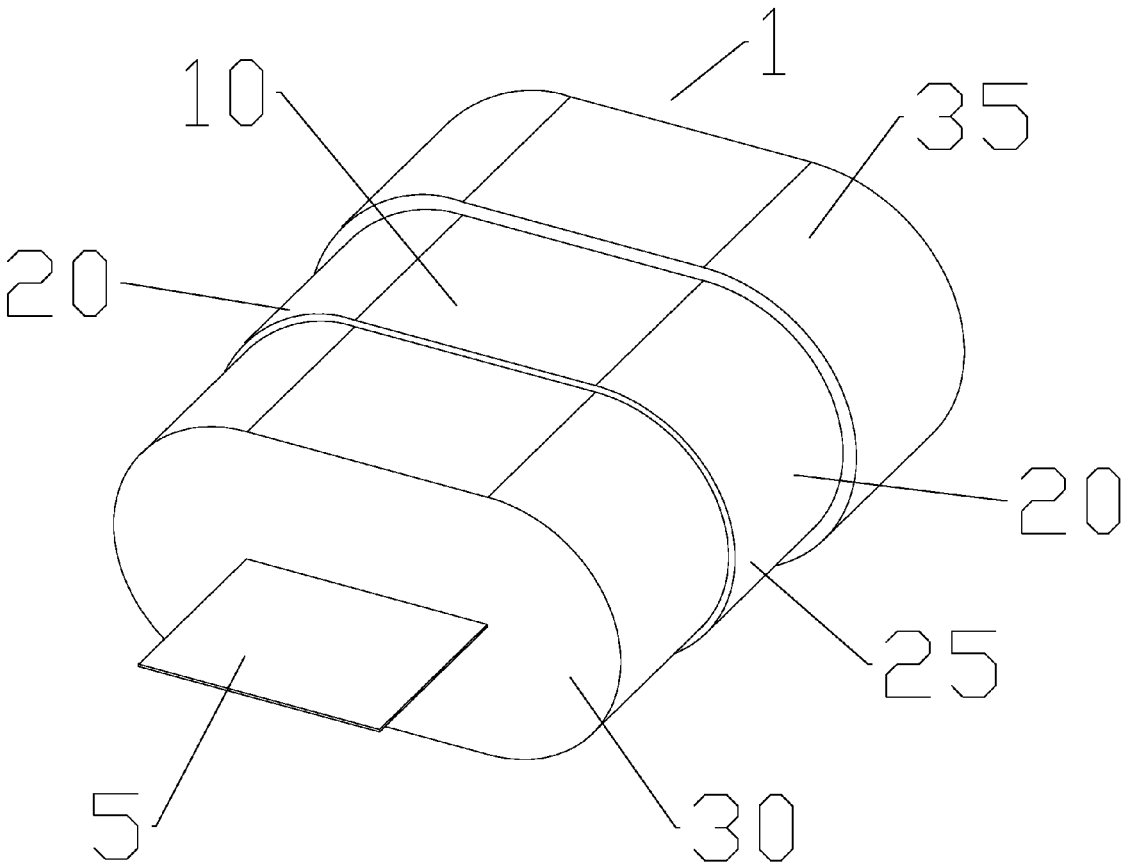
FIG. 1 is a schematic isometric view of an exemplary cable, with layers of the conductors, dielectric spacer and outer jacket stripped back.
Figure 2:
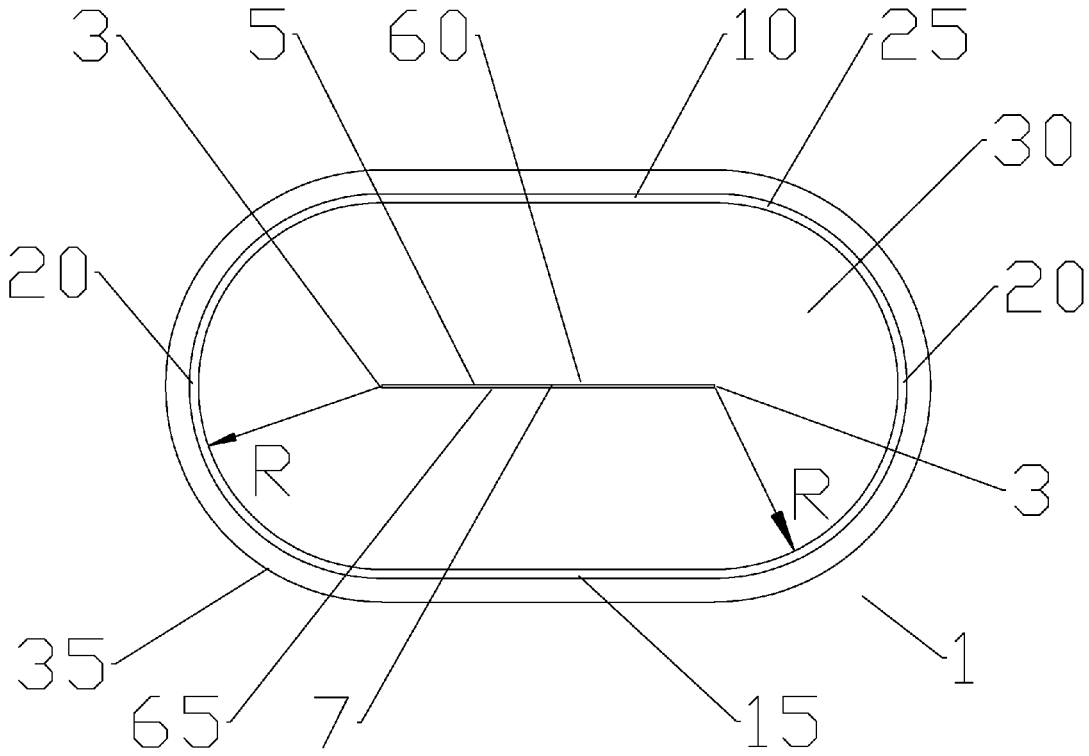
FIG. 2 is a schematic end view of the cable of FIG. 1.
Figure 3:
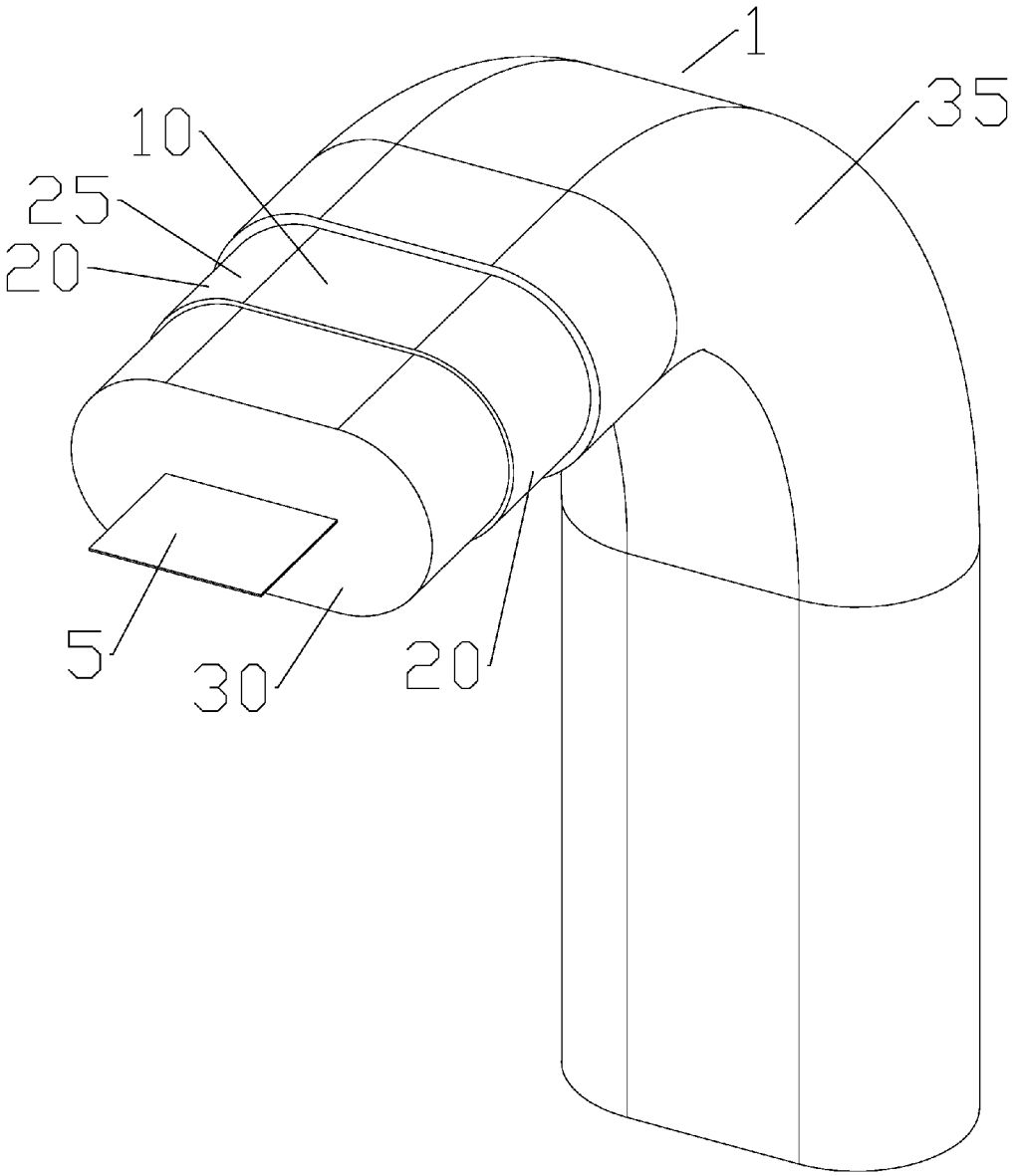
FIG. 3 is a schematic isometric view demonstrating a bend radius of the cable of FIG. 1.

An exemplary stripline RF transmission cable 1 is demonstrated in FIGS. 1-3. As best shown in FIG. 1, the inner conductor 5 of the cable 1, extending between a pair of inner conductor edges 3, is a generally flat metallic strip. A top section 10 and a bottom section 15 of the outer conductor 25 may be aligned parallel to the inner conductor 5 with widths generally equal to the inner conductor width. The top and bottom sections 10, 15 transition at each side into convex edge sections 20. Thus, the circumference of the inner conductor 5 is entirely sealed within an outer conductor 25 comprising the top section 10, bottom section 15 and edge sections 20.

The dimensions/curvature of the edge sections 20 may be selected, for example, for ease of manufacture. Preferably, the edge sections 20 and any transition thereto from the top and bottom sections 10, 15 is generally smooth, without sharp angles or edges. As best shown in FIG. 2, the edge sections 20 may be provided as circular arcs with an arc radius R, with respect to each side of the inner conductor 5, equivalent to the spacing between each of the top and bottom sections 10, 15 and the inner conductor 5, resulting in a generally equal spacing between any point on the circumference of the inner conductor 5 and the nearest point of the outer conductor 25, minimizing outer conductor material requirements.

The desired spacing between the inner conductor 5 and the outer conductor 25 may be obtained with high levels of precision via application of a uniformly dimensioned spacer structure with dielectric properties, referred to as the dielectric layer 30, and then surrounding the dielectric layer 30 with the outer conductor 25. Thereby, the cable 1 may be provided in essentially unlimited continuous lengths with a uniform cross section at any point along the cable 1.

The inner conductor 5 metallic strip may be formed as solid rolled metal material such as copper, aluminum, steel or the like. For additional strength and/or cost efficiency, the inner conductor 5 may be provided as copper coated aluminum or copper coated steel.

Figure 4:
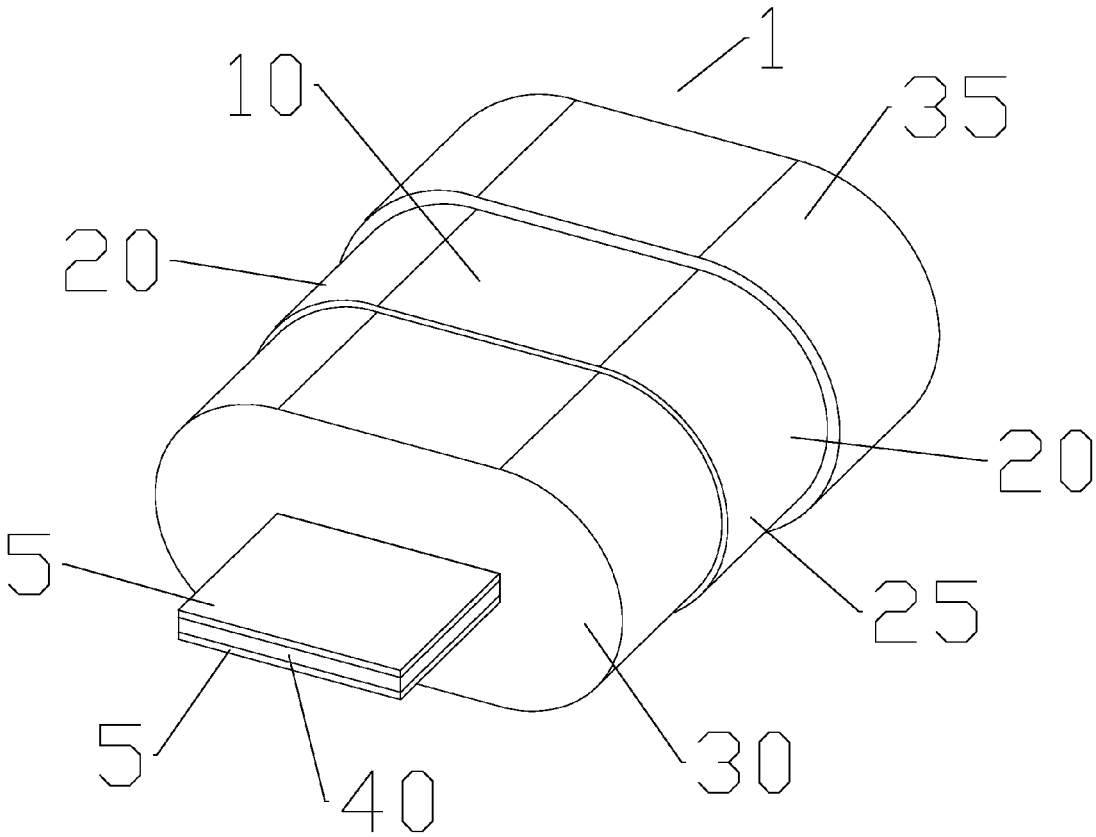
FIG. 4 is a schematic isometric view of an alternative cable, with layers of the conductors, dielectric spacer and outer jacket stripped back.

Alternatively, the inner conductor 5 may be provided as a substrate 40 such as a polymer and/or fiber strip that is metal coated or metalized, for example as shown in FIG. 4. One skilled in the art will appreciate that such alternative inner conductor configurations may enable further metal material reductions and/or an enhanced strength characteristic enabling a corresponding reduction of the outer conductor strength characteristics.

The dielectric layer 30 may be applied as a continuous wall of plastic dielectric material around the outer surface of the inner conductor 5. Additionally, expanded blends of high and/or low density polyethylene, solid or foamed, may be applied as the dielectric layer 30.

The outer conductor 25 is electrically continuous, entirely surrounding the circumference of the dielectric layer 30 to eliminate radiation and/or entry of interfering electrical signals. The outer conductor 25 may be a solid material such as aluminum or copper material sealed around the dielectric layer as a contiguous portion by seam welding or the like. Alternatively, helical wrapped and/or overlapping folded configurations utilizing, for example, metal foil and/or braided type outer conductor 25 may also be utilized. A protective jacket 35 of polymer materials such as polyethylene, polyvinyl chloride, polyurethane and/or rubbers may be applied to the outer diameter of the outer conductor.

Electrical modeling of stripline-type RF cable structures with top and bottom sections with a width similar to that of the inner conductor (as shown in FIGS. 1-4) demonstrates that the electric field generated by transmission of an RF signal along the cable 1 and the corresponding current density with respect to a cross section of the cable 1 is greater along the inner conductor edges 3 at either side of the inner conductor 5 than at a mid-section 7 of the inner conductor.

The materials selected for the dielectric layer 30, in addition to providing varying dielectric constants for tuning the dielectric layer cross section dielectric profile for attenuation reduction, may also be selected to enhance structural characteristics of the resulting cable 1.

Figure 5:
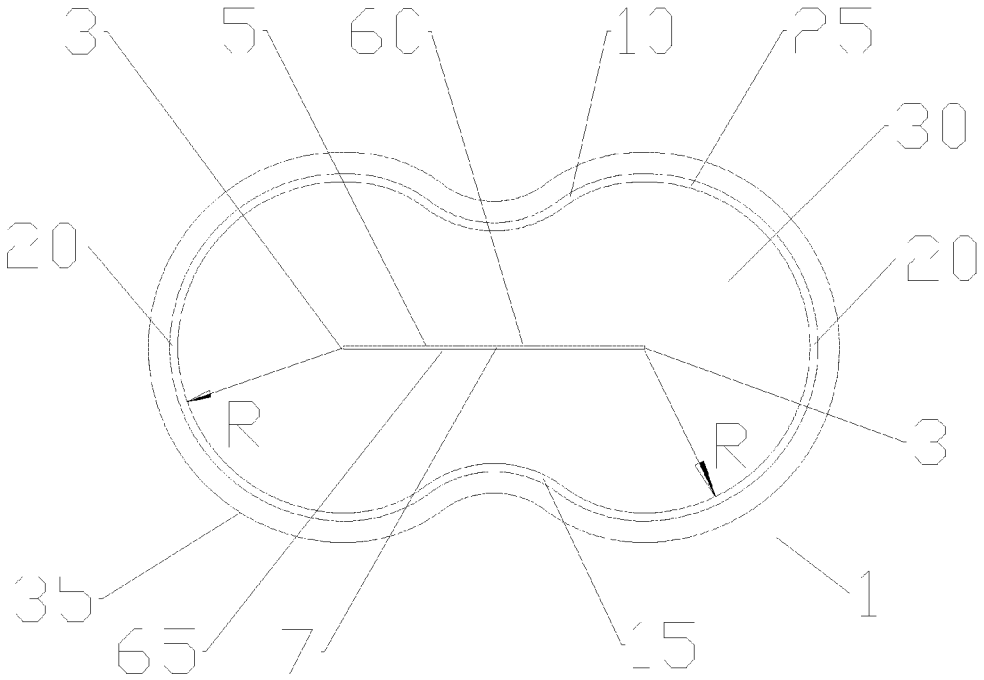
FIG. 5 is a schematic end view of an alternative embodiment cable utilizing varied outer conductor spacing to modify operating current distribution within the cable.
Figure 6:
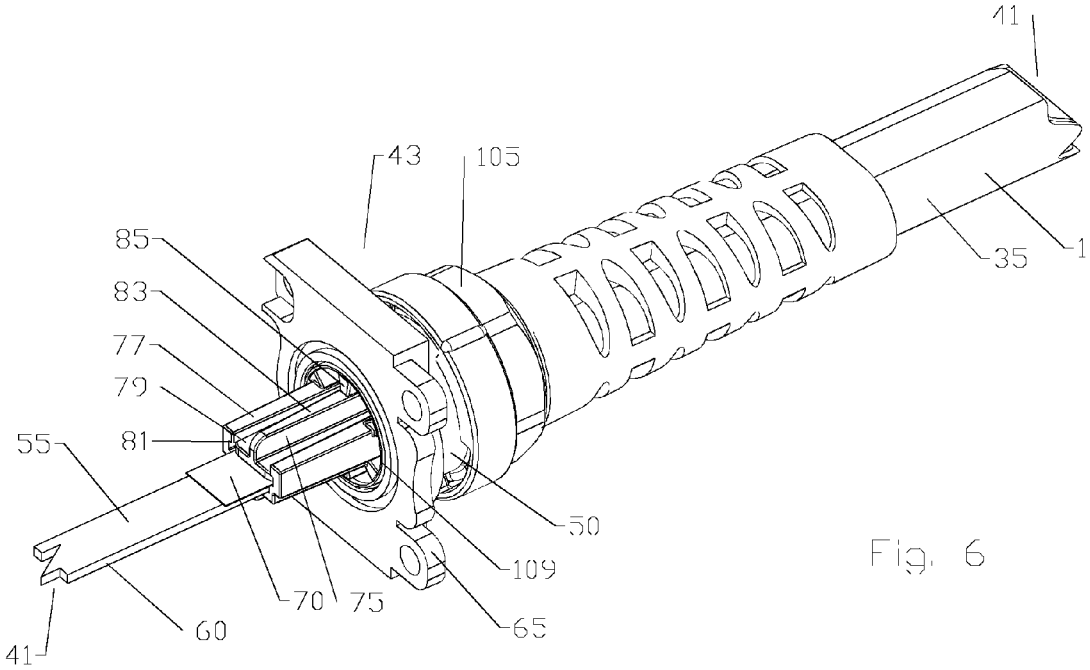
FIG. 6 is a schematic isometric view of an exemplary cable and connector, the male and female connector bodies coupled together.

Alternatively and/or additionally, the electric field strength and corresponding current density may also be balanced by adjusting the distance between the outer conductor 25 and the mid-section 7 of the inner conductor 5. For example as shown in FIG. 5, the outer conductor 25 may be provided spaced farther away from each inner conductor edge 3 than from the mid-section 7 of the inner conductor 5, creating a generally hourglass-shaped cross-section. The distance between the outer conductor 25 and the mid-section 7 of the inner conductor 5 may be less than, for example, 0.7 of a distance between the inner conductor edges 3 and the outer conductor 25 (at the edge sections 20).

A capacitively coupled flat conductor connector 43 for terminating a flat inner conductor stripline RF transmission cable 1 is demonstrated in FIGS. 6-12. By applying capacitive coupling at the connection interface, the potential for PIM generation with respect to the inner conductor 5 may be eliminated.

Figure 11:
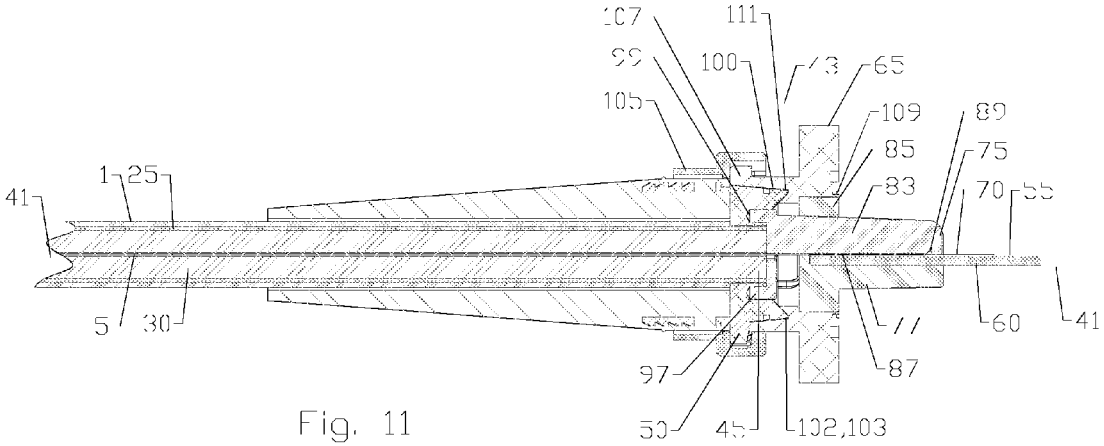
FIG. 11 is a schematic cross-section view, taken along line A-A of FIG. 9.
Figure 12:
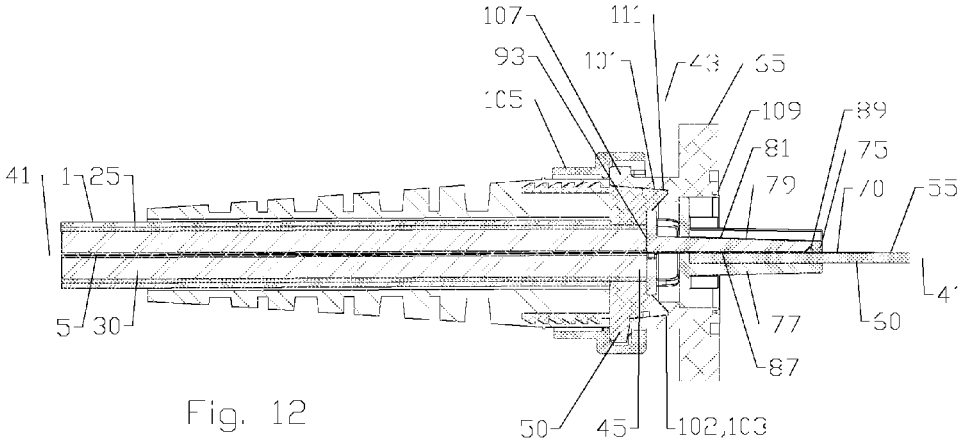
FIG. 12 is a schematic cross-section view, taken along line C-C of FIG. 10.

As best shown in FIGS. 11 and 12, the outer conductor 25, inserted at the cable end 41 and extending therethrough to proximate the connector end 42, seats within a bore 45 of the male connector body 50, coupled with the male connector body 50, for example, via a molecular bond obtained by laser, friction or ultrasonic welding the circumference of the joint between the outer conductor 25 and the male connector body 50, for example as described in US Utility Patent Application Publication No.: 2012-0129391, titled "Connector and Coaxial Cable with Molecular Bond Interconnection" published 24 May 2012, hereby incorporated by reference in its entirety.

One skilled in the art will appreciate that cable end 41 and connector end 42 are applied herein as identifiers for respective ends of both the connector and also of discrete elements of the connector described herein, to identify same and their respective interconnecting surfaces according to their alignment along a longitudinal axis of the connector between an connector end 42 and a cable end 41 of each of the male and female connector bodies 50, 65. When interconnected by the connector interface, the connector end 42 of the male connector 50 is coupled to the connector end 42 of the female connector 65.

A "molecular bond" as utilized herein is defined as an interconnection in which the bonding interface between two elements utilizes exchange, intermingling, fusion or the like of material from each of two elements bonded together. The exchange, intermingling, fusion or the like of material from each of two elements generates an interface layer where the comingled materials combine into a composite material comprising material from each of the two elements being bonded together.

One skilled in the art will recognize that a molecular bond may be generated by application of heat sufficient to melt the bonding surfaces of each of two elements to be bonded together, such that the interface layer becomes molten and the two melted surfaces exchange material with one another. Then, the two elements are retained stationary with respect to one another, until the molten interface layer cools enough to solidify.

The resulting interconnection is contiguous across the interface layer, eliminating interconnection quality and/or degradation issues such as material creep, oxidation, galvanic corrosion, moisture infiltration and/or interconnection surface shift.

The inner conductor 5 extends through the bore 45 for capacitive coupling with a mating conductor 55, such as an inner conductor trace on a printed circuit board 60, supported by a female connector body 65. Because the inner conductor 5 and mating conductor 55 are generally flat, the capacitive coupling between the inner conductor 5 and the mating conductor 55 is between two planar surfaces. Thereby, alignment and spacing to obtain the desired level of capacitive coupling may be obtained by adjusting the overlap and/or offset between the capacitive coupled surfaces.

Figure 7:
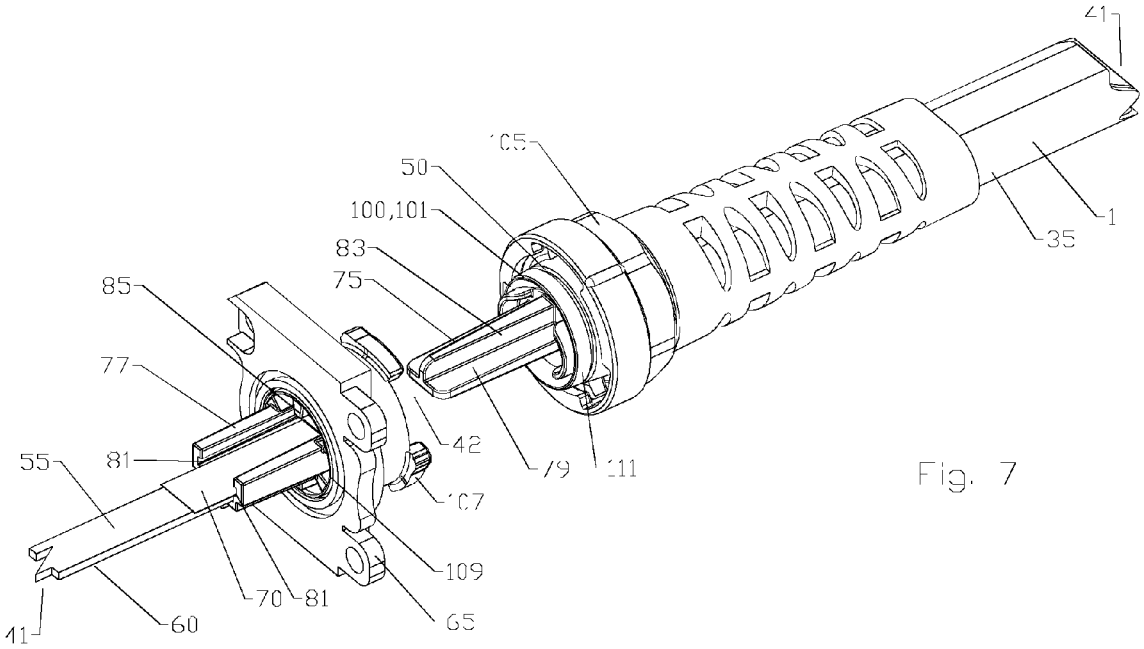
FIG. 7 is a schematic isometric view of the cable and connector of FIG. 6, the male and female connector bodies aligned for insertion.
Figure 8:
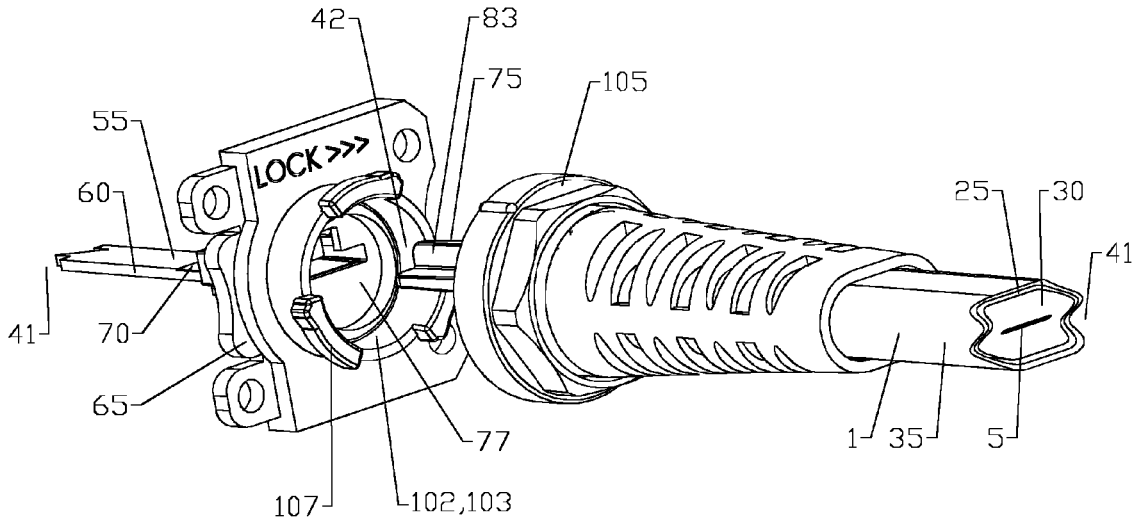
FIG. 8 is a schematic isometric alternative angle view of the cable and connector of FIG. 7.
Figure 9:
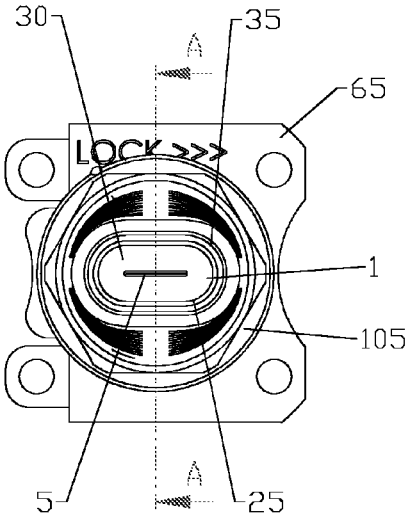
FIG. 9 is a schematic end view of the cable and connector of FIG. 6, from the cable end.
Figure 10:
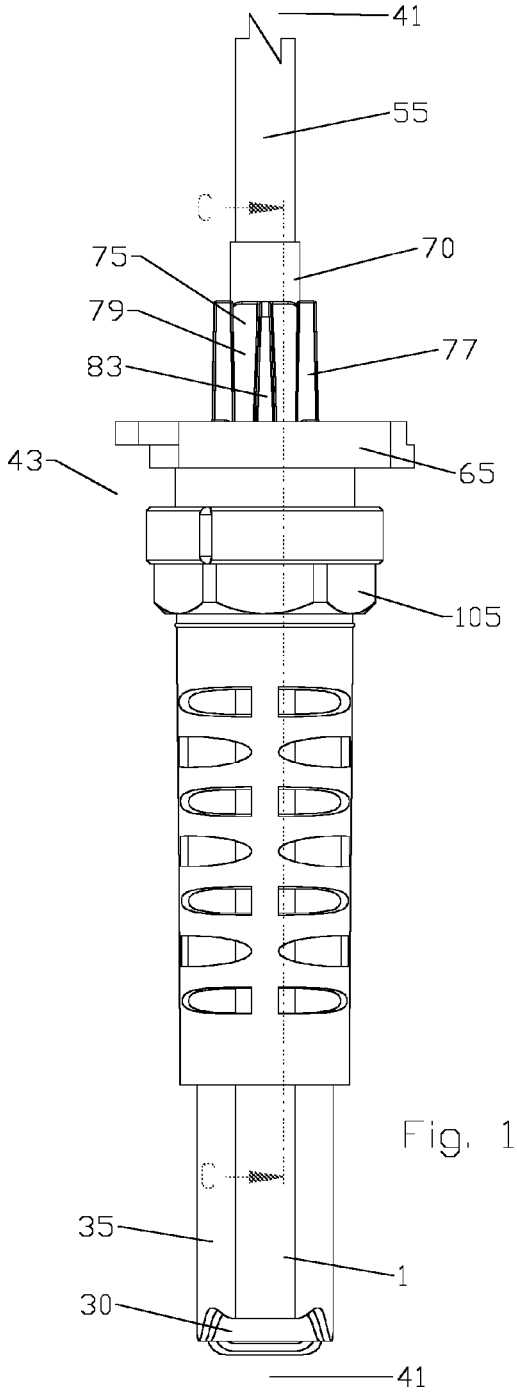
FIG. 10 is a schematic side view of the cable and connector of FIG. 6.

As best shown in FIGS. 7 and 8, the offset between the inner conductor 5 and the mating conductor 55 may be selected by insertion of a dielectric spacer 70 therebetween, for example adhered to the mating conductor 55. The dielectric spacer 70 may be any dielectric material with desired thickness, strength and/or abrasion resistance characteristics, such as a yttria-stabilized zirconia ceramic material. Such materials are commercially available, for example, in sheets with high precision thicknesses as thin as 0.002".

Where the inner conductor 5 and the mating conductor 55 are retained parallel to and aligned one above the other with respect to width, the surface area between the capacitively coupled surfaces is determined by the amount of longitudinal overlap applied between the two. With the offset provided as a constant (the thickness of the selected dielectric spacer 70), the overlap may be adjusted to tune the capacitive coupling for a desired frequency band of the RF signals to be transmitted along the cable 1.

Figure 13:
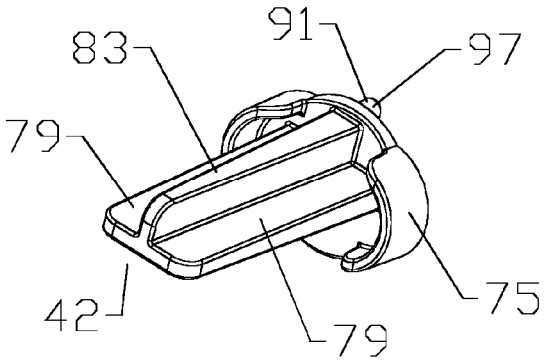
FIG. 13 is a schematic isometric angled top view of an alignment insert.
Figure 14:
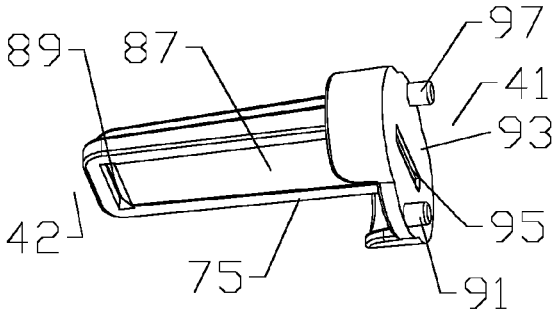
FIG. 14 is a schematic isometric angled bottom view of an alignment insert.
Figure 15:
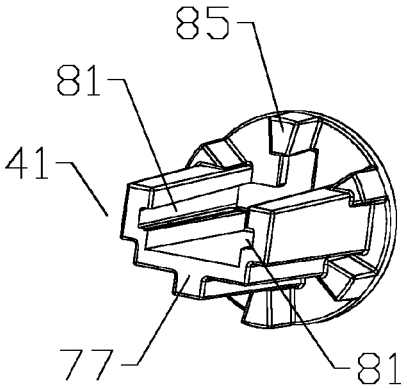
FIG. 15 is a schematic isometric angled end view of an alignment receptacle.

Precision alignment of the inner conductor 5 and the mating conductor 55 may be facilitated by an alignment insert 75, for example as shown in FIGS. 13 and 14, coupled to the male connector body 50, and an alignment receptacle 77, for example as shown in FIG. 15, coupled to the female connector body 65, which key with one another longitudinally along a ramp surface 79 on a connector end 42 of the alignment insert 75 that seats against an angled groove 81 of the alignment receptacle 77. Thereby, longitudinal advancement of the alignment insert 75 into the alignment receptacle 77 drives the inner conductor 5 and the mating conductor 55 laterally toward one another until they bottom against one another, separated by the dielectric spacer, for example as shown in FIGS. 11 and 12.

Figure 16:
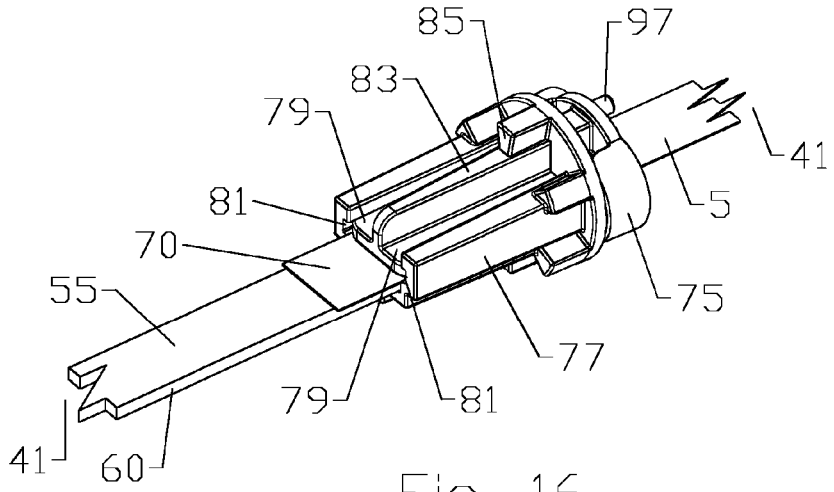
FIG. 16 is a schematic isometric view of an alignment insert seated within an alignment receptacle.

The alignment between the alignment insert 75 and the alignment receptacle 77 may be further enhanced by applying the ramp surface 79 and angled groove 81 to both sides of the alignment insert 75 and alignment receptacle 77, as best shown in FIG. 16. The alignment insert 75 may be reinforced by application of a support spline 83 extending normal to the ramp surface 79. Further, the support spline 83 may be configured as a further ramp element that engages a center portion 85 of the alignment receptacle 77 as the alignment insert 75 and alignment receptacle 77 approach their full engagement position, as best shown in FIGS. 11 and 16.

Figure 17:
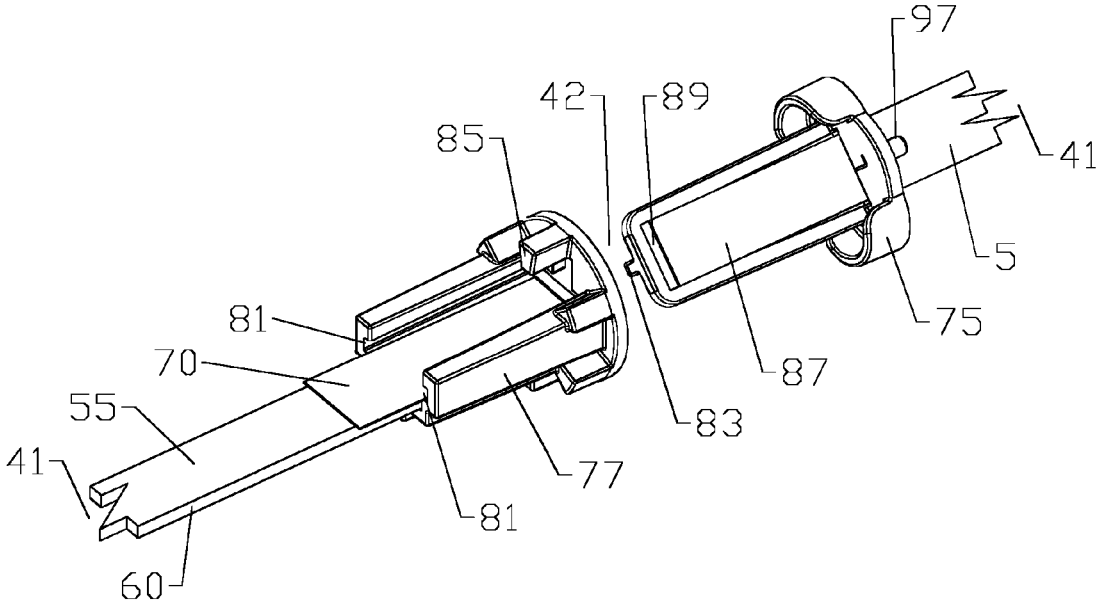
FIG. 17 is a schematic isometric view of the alignment insert and alignment receptacle of FIG. 16, in an exploded view showing a bottom of the alignment insert with an inner conductor seated within the conductor seat.

As best shown in FIGS. 14 and 17, the fit of the inner conductor 5 within the alignment insert 75 may be further controlled by application of a conductor seat 87 formed as a trough on the alignment insert 75, the trough provided with a specific length corresponding to the desired overlap between the inner conductor 5 and the mating conductor 55.

The conductor seat 87 may also be used as a guide for cable end preparation. By test fitting the alignment insert 75 against the male connector body 50 with the inner conductor 5 extending over the conductor seat 87, the connector end 42 of the conductor seat 87 demonstrates the required trim point along the inner conductor 5 for correct fit of the inner conductor 5 into the conductor seat 87 and thereby the length of the inner conductor 5 necessary to obtain the desired overlap.

Application of a transverse trough 89 proximate the connector end 42 of the conductor seat 87, as best shown in FIG. 14, reduces the requirements for applying a precise trim cut to the inner conductor 5 by providing a cavity for folding the tip of the inner conductor 5 away from the mating conductor 55, as shown in FIGS. 11 and 12, rendering this portion essentially inoperative with respect to overlap. Because the position of the transverse trough 89 may be formed with high precision during manufacture of the alignment insert 75, for example by injection molding, the desired length of the inner conductor 5 overlapping the mating conductor 55 is obtained even if a low precision trim cut is applied as the excess extent of the inner conductor 5 is then folded away from the dielectric spacer 70 into the transverse trough 89. Further, the bend of the inner conductor 5 into the transverse trough 89 provides a smooth leading inner conductor edge to reduce the potential for damage to the dielectric spacer 70 as the alignment insert 75 with inner conductor 5 is inserted into the alignment receptacle 77, across the dielectric spacer 70.

As best shown in FIG. 11, the alignment insert 75 may be removably coupled to the male connector body 50 via an attachment feature 91 provided in a mounting face 93 normal to a longitudinal axis of the alignment insert 75, the mounting face 93 provided with an inner conductor slot 95 dimensioned to receive the inner conductor 5 therethrough. The attachment feature may be, for example, at least one protrusion 97 which mates with a corresponding coupling aperture 99 of the male connector body 50. The alignment receptacle 77 may be permanently coupled to the female connector body 65 by swaging a sidewall of an annular swage groove 109 of the female connector body 65 against an outer diameter of the alignment receptacle 77, for example as shown in FIGS. 11 and 12.

Figure 18:
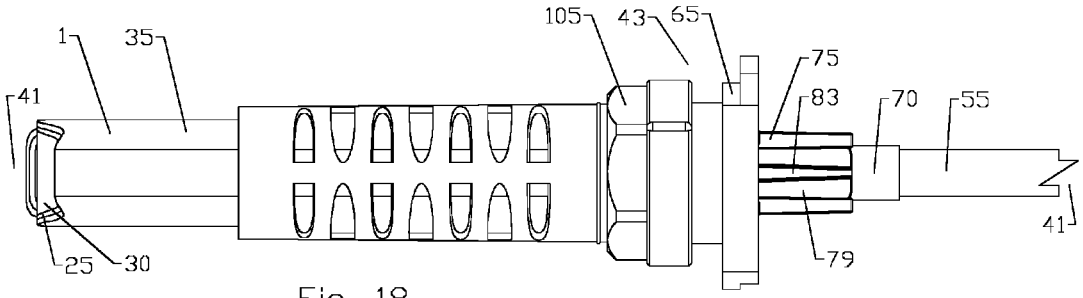
FIG. 18 is a schematic side view of a cable and connector interconnection utilizing a low band alignment insert.
Figure 19:
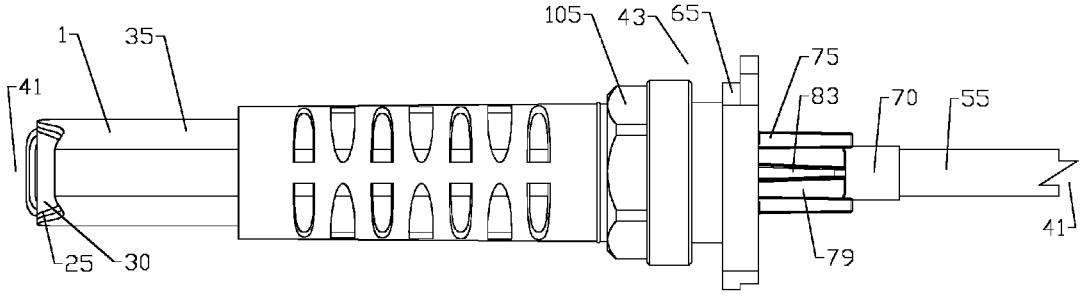
FIG. 19 is a schematic side view of a cable and connector interconnection utilizing a middle band alignment insert.
Figure 20:
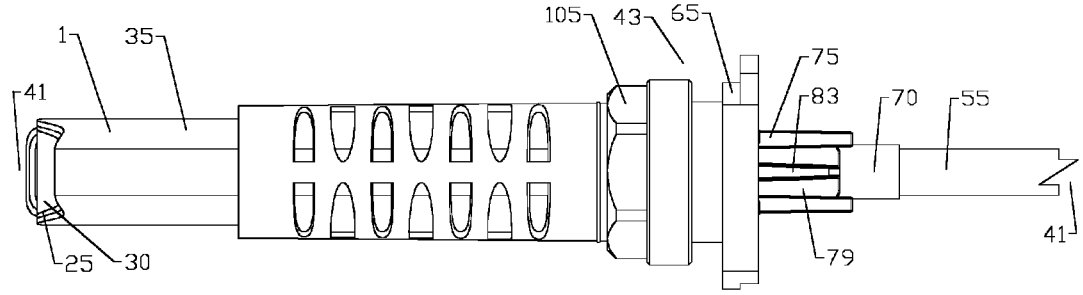
FIG. 20 is a schematic side view of a cable and connector interconnection utilizing a high band alignment insert.

One skilled in the art will appreciate that, because the overlap may be defined by the dimensions of the conductor seat 87, the capacitive coupling may be quickly precision tuned for a range of different frequency bands by selection between a plurality of alignment inserts 75, each of the alignment inserts 75 provided with conductor seats 87 of varied longitudinal length, for example as shown in FIGS. 18-20.

As best shown in FIGS. 7 and 8, a coupling arrangement between the male connector body 50 and the female connector body 65 securely retains the alignment insert 75 and alignment receptacle 77 together. The coupling may be applied in a quick connect configuration, for example as described in US Utility Patent Application Publication No.: 2012-0129375, titled "Tabbed Connector Interface" published 24 May 2012, hereby incorporated by reference in its entirety, wherein the connector end 42 of the male connector body 50 is provided with a male outer conductor coupling surface 100, here provided as the conical outer diameter of a seat surface 101 at the connector end 42. The seat surface 101 is dimensioned to seat against a female outer conductor coupling surface 102, here provided as an annular groove 103 of the female connector body 65, the annular groove 103 open to the connector end 42. The male connector body 50 is provided with a lock ring 105 adapted to engage base tabs 107 of the female connector body 65 to retain the seat surface 101 against the annular groove 103.

Figure 21:
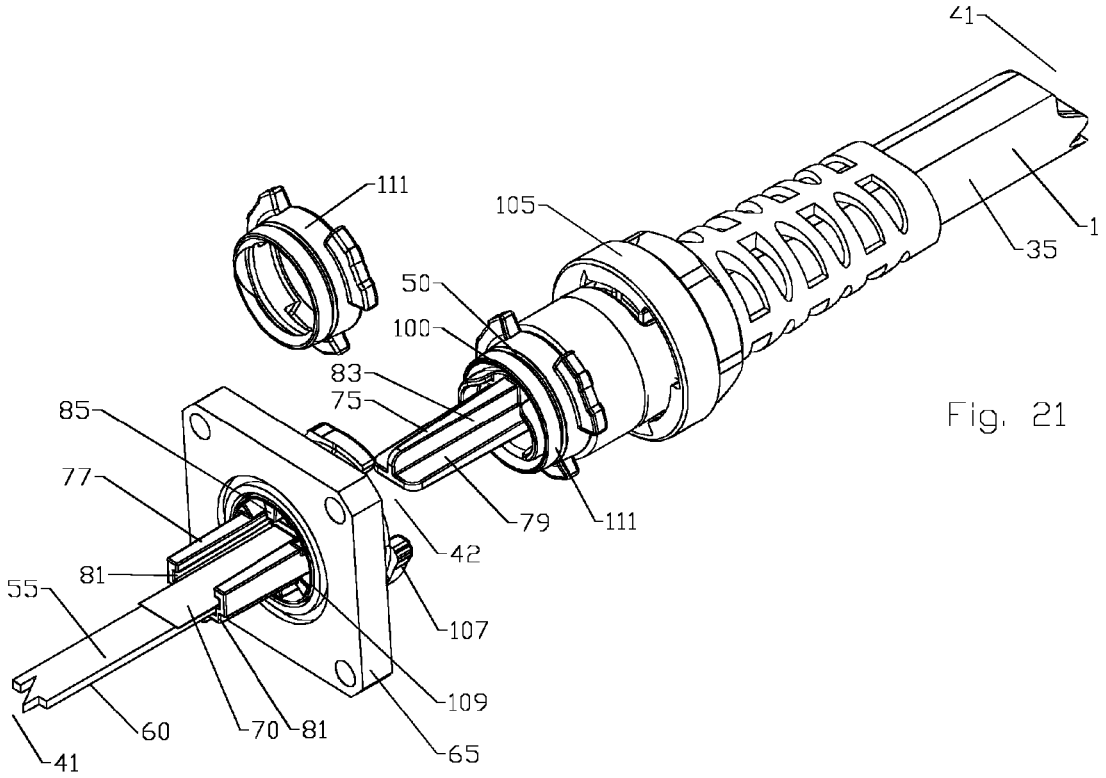
FIG. 21 is a schematic isometric view of another embodiment, aligned for insertion, with a schematic demonstration of the outer conductor dielectric spacer.
Figure 22:
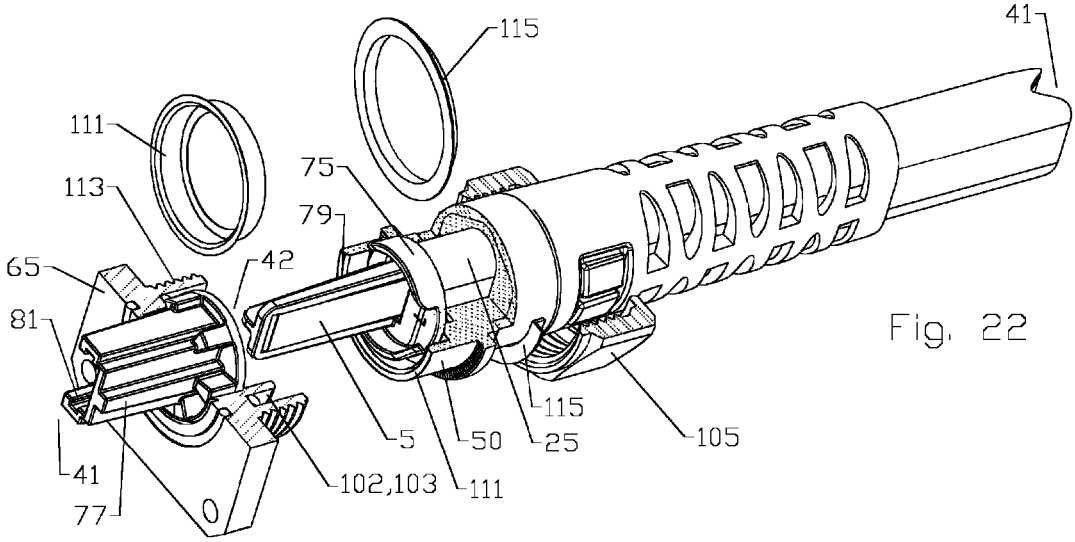
FIG. 22 is a schematic isometric view of another embodiment, aligned for insertion, with a schematic demonstration of the outer conductor dielectric spacer and a lock ring dielectric spacer.

To form an entirely capacitively coupled interconnection interface, an outer conductor dielectric spacer 111 may be applied to the outer conductor interconnections of the interface. The outer conductor dielectric spacer 111 may be applied, for example as shown in FIGS. 21 and 22, with respect to the outer conductor 25 by coating connection surfaces of the connector end 42 of the male connector body 50 (the seat surface 101) or female connector body 65 (contacting portions of the annular groove 103) with a dielectric coating. Where a tabbed connector interface is applied, the outer conductor dielectric spacer 111 may be applied covering the base tabs 107. Thereby, when the male connector body 50 is secured within a corresponding female connector body 65, an entirely capacitively coupled interconnection interface is formed. That is, there is no direct galvanic interconnection between the inner conductor 5 or outer conductor 25 electrical pathways across the connection interface.

The outer conductor dielectric spacer 111 may be provided, for example, as a ceramic or polymer dielectric material. One example of a dielectric coating with suitable compression and thermal resistance characteristics that may be applied with high precision at very thin thicknesses is a ceramic coating. Ceramic coatings may be applied directly to the desired surfaces via a range of deposition processes, such as Physical Vapor Deposition (PVD) or the like. Ceramic coatings have a further benefit of a high hardness characteristic, thereby protecting the coated surfaces from damage prior to interconnection and/or resisting thickness variation due to compressive forces present upon interconnection. The ability to apply extremely thin dielectric coatings, for example as thin as 0.5 microns, may reduce the surface area requirement of the separated conductor surfaces, enabling the overall dimensions of the connection interface to be reduced.

Figure 23:
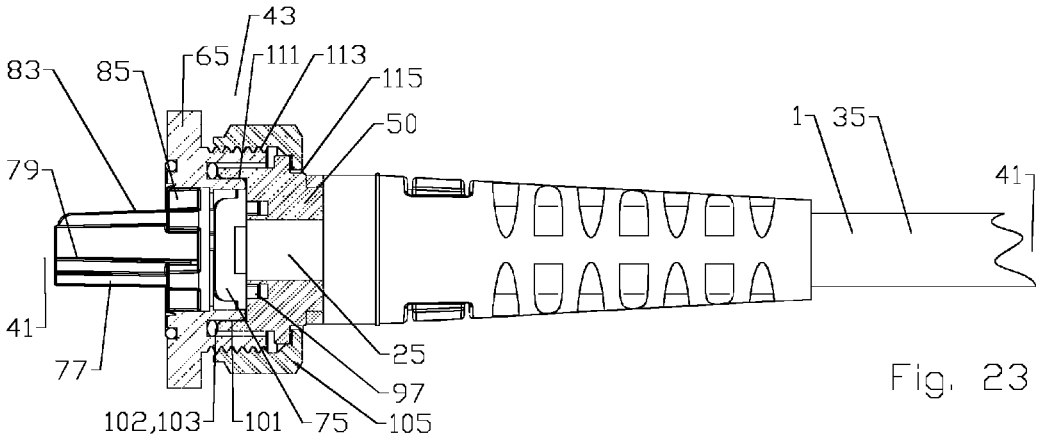
FIG. 23 is a schematic partial cut-away side view of the embodiment of FIG. 22, in an interconnected position.

Alternatively, capacitive coupling may be applied to connection interfaces with conventional threaded lock ring configurations. For example, as shown in FIGS. 22 and 23, a variation of the outer conductor elements of a standard DIN connector interface applies telescopic mating between the seat surface 101 and the annular groove 103, wherein the outer conductor dielectric spacer 111 is applied to the male outer conductor seat surface 100, here provided as a seat surface 101 on an inner diameter of the connector end 42 of the male connector body 50 and the inner sidewall of the annular groove 103 of the female connector body 65.

The lock ring 105 has been demonstrated formed from a dielectric material, for example a fiber-reinforced polymer. Therefore, the lock ring 105 does not create a galvanic electro-mechanical coupling between the male connector body 50 and the female connector body 65. Where the additional wear and/or strength characteristics of a metal material lock ring 105 are desired, for example where the lock ring 105 is a conventional threaded lock ring that couples with threads 113 of the female connector body 65 to draw the male and female connector bodies 50, 65 together and secure them in the interconnected position, a lock ring dielectric spacer 115 (see FIG. 22) may be applied, between seating surfaces of the lock ring 105 and the male connector body 50 to electrically isolate the lock ring 105 from the male connector body 50, for example as shown in FIGS. 22 and 23.

One skilled in the art will appreciate that the cable 1 and capacitive coupling connector 43 provide numerous advantages over a conventional circular cross section coaxial cable and connector embodiments. The flat inner conductor 5 configuration enables a direct transition to planar elements, such as traces on printed circuit boards and/or antennas. The capacitive coupling connector 43 may eliminate PIM with respect to the inner and outer conductors 5, 25 and is easily assembled for operation with a range of different frequency bands via simple exchange of the alignment insert 75.

Table of Parts

| | |
|---|---|
| 1 | cable |
| 3 | inner conductor edge |
| 5 | inner conductor |
| 7 | mid-section |
| 10 | top section |
| 15 | bottom section |
| 20 | edge section |
| 25 | outer conductor |
| 30 | dielectric layer |
| 35 | jacket |
| 40 | substrate |
| 41 | cable end |
| 42 | connector end |
| 43 | connector |
| 45 | bore |
| 50 | male connector body |
| 55 | mating conductor |
| 60 | printed circuit board |
| 65 | female connector body |
| 70 | dielectric spacer |
| 75 | alignment insert |
| 77 | alignment receptacle |
| 79 | ramp surface |
| 81 | angled groove |
| 83 | support spline |
| 85 | center portion |
| 87 | conductor seat |
| 89 | transverse trough |
| 91 | attachment feature |
| 93 | mounting face |
| 95 | slot |
| 97 | protrusion |
| 99 | coupling aperture |
| 100 | male outer conductor seat surface |
| 101 | seat surface |
| 102 | female outer conductor seat surface |
| 103 | annular groove |
| 105 | lock ring |
| 107 | base tab |
| 109 | swage groove |
| 111 | outer conductor dielectric spacer |
| 113 | threads |
| 115 | lock ring dielectric spacer |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A capacitively coupled flat conductor connector, for interconnection with a female connector body provided with a female outer conductor coupling surface at a connector end of the female connector body and an alignment receptacle coupled to the female connector body; comprising:

a male connector body provided with a bore and a male outer conductor coupling surface provided at a connector end of the male connector body;

an outer conductor dielectric spacer dimensioned to cover the male outer conductor coupling surface;

an alignment insert coupled to the male connector body; the alignment insert dimensioned to support a predefined length of an inner conductor seated within the bore;

the male outer conductor coupling surface dimensioned to seat, spaced apart by the outer conductor dielectric spacer, against the female outer conductor coupling surface;

the alignment receptacle dimensioned to receive a connector end of the alignment insert to seat an overlapping portion of the inner conductor and a mating conductor seated in the alignment receptacle parallel with one another against opposite sides of a dielectric spacer.

2. The connector of claim 1, wherein the male outer conductor coupling surface is provided with a conical outer diameter seat surface at the connector end;

the seat surface dimensioned to seat against an annular groove of the female outer conductor coupling surface.

3. The connector of claim 2, further including a lock ring adapted to engage base tabs of the female connector body to retain the seat surface against the annular groove.

4. The connector of claim 3, wherein the lock ring is a dielectric material.

5. The connector of claim 3, wherein the lock ring is electrically isolated from the male connector body by a lock ring dielectric spacer.

6. The connector of claim 1, wherein the male outer conductor coupling surface is provided with a seat surface provided on an inner diameter of the male connector body proximate the connector end; the seat surface dimensioned to seat against an inner sidewall of an annular groove of the female outer conductor coupling surface.

7. The connector of claim 6, further including a lock ring adapted to engage threads of the female connector body to retain the seat surface against the annular groove.

8. The connector of claim 1, wherein the outer conductor is coupled to the male connector body in a molecular bond.

9. The connector of claim 1, further including a ramp surface on the alignment insert that seats against an angled groove of the alignment receptacle, whereby longitudinal advancement of the alignment insert into the alignment receptacle drives the inner conductor and the mating conductor laterally towards one another.

10. The connector of claim 9, wherein the ramp surface and angled groove are provided on first and second sides of the alignment insert and alignment receptacle.

11. The connector of claim 1, further including a conductor seat on a bottom of the alignment insert; the conductor seat dimensioned to receive a predefined length of the inner conductor.

12. The connector of claim 11, further including a transverse trough in the conductor seat, proximate a connector end of the conductor seat.

13. The connector of claim 1, further including a support spline on the alignment insert; the support spline extending normal to the conductor seat.

14. The connector of claim 1, wherein the alignment insert couples to the male connector body via at least one protrusion which mates with a corresponding coupling aperture of the male connector body.

15. The connector of claim 1, wherein the alignment insert has a mounting face normal to a longitudinal axis of the alignment insert, the mounting face provided with an inner conductor slot dimensioned to receive the inner conductor therethrough.

16. A method for manufacturing a connector according to claim 1, comprising the steps of:

forming the outer conductor dielectric spacer as a layer of ceramic material upon the male outer conductor coupling surface.

17. The method of claim 16, wherein the ceramic material is applied by physical vapor deposition upon the seating surface.

18. A method for manufacturing a connector according to claim 1, comprising the steps of:

forming the outer conductor dielectric spacer as a layer of ceramic material upon the female outer conductor coupling surface.

19. A capacitively coupled flat conductor connector, for interconnection with a female connector body provided with a female outer conductor coupling surface at a connector end of the female connector body; comprising:

a male connector body provided with a bore and a male outer conductor coupling surface provided at a connector end of the male connector body;

an outer conductor dielectric spacer dimensioned to cover the male outer conductor coupling surface;

the male outer conductor coupling surface dimensioned to seat, spaced apart by the outer conductor dielectric spacer, against the female outer conductor coupling surface;

alignment elements of the male connector body and the female connector body supporting an inner conductor and a mating conductor, respectively, the inner conductor and the mating conductor parallel to one another and overlapping one another longitudinally, separated by a dielectric spacer.

20. The connector of claim 19, wherein the alignment elements are an alignment receptacle coupled to the female connector body and an alignment insert coupled to the male connector body;

the alignment insert dimensioned to support a predefined length of the inner conductor seated within the bore;

the alignment receptacle dimensioned to receive a connector end of the alignment insert to seat an overlapping portion of the inner conductor opposite the mating conductor.

* * * * *